US009080362B2

(12) United States Patent
Johnson et al.

(10) Patent No.: US 9,080,362 B2
(45) Date of Patent: Jul. 14, 2015

(54) SHOWER DOOR BUMPER

(71) Applicant: Kohler Co., Kohler, WI (US)

(72) Inventors: Mark A. Johnson, Plymouth, WI (US); Roque M. Corpuz, Jr., Sheboygan, WI (US); Nate Grev, Rochester, MN (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 14/478,943

(22) Filed: Sep. 5, 2014

(65) Prior Publication Data

US 2015/0068127 A1 Mar. 12, 2015

Related U.S. Application Data

(60) Provisional application No. 61/874,785, filed on Sep. 6, 2013.

(51) Int. Cl.

| | |
|---|---|
| ***E05F 5/02*** | (2006.01) |
| ***E05F 5/00*** | (2006.01) |
| ***E05F 5/06*** | (2006.01) |
| ***E05D 13/00*** | (2006.01) |
| ***E05D 15/06*** | (2006.01) |
| ***A47K 3/34*** | (2006.01) |

(52) U.S. Cl.

CPC . *E05F 5/003* (2013.01); *A47K 3/34* (2013.01); *E05D 13/00* (2013.01); *E05D 15/0652* (2013.01); *E05F 5/06* (2013.01)

(58) Field of Classification Search

CPC ..... E05F 5/003; E05F 5/06; E05D 13/00; E05D 15/0652; A47K 3/34

USPC ..... 49/460; 16/82, 86 B; 4/612, 614

See application file for complete search history.

(56) References Cited

U.S. PATENT DOCUMENTS

| | | | | |
|---|---|---|---|---|
| 3,333,363 | A * | 8/1967 | Garvey | 49/425 |
| 3,658,398 | A * | 4/1972 | Abbate et al. | 312/333 |
| 5,233,724 | A * | 8/1993 | Lei tert et al. | 16/86 A |
| 5,242,222 | A * | 9/1993 | Michael | 312/334.45 |
| 5,718,083 | A * | 2/1998 | Dowdell, II | 49/407 |
| 5,895,089 | A * | 4/1999 | Singh et al. | 296/207 |
| 6,052,867 | A * | 4/2000 | Haab et al. | 16/87.6 R |
| 6,438,795 | B1 * | 8/2002 | Haab et al. | 16/85 |
| 6,487,752 | B1 * | 12/2002 | Mathews | 16/86 B |
| 6,516,575 | B2 * | 2/2003 | Haab et al. | 52/243.1 |
| 7,886,403 | B2 * | 2/2011 | Nezu et al. | 16/87 R |
| 8,336,972 | B2 * | 12/2012 | Haab et al. | 312/322 |
| 8,915,019 | B2 * | 12/2014 | Schachter et al. | 49/425 |
| 2004/0098831 | A1 * | 5/2004 | Elmer | 16/89 |
| 2006/0145007 | A1 * | 7/2006 | Melberg et al. | 244/118.5 |
| 2010/0242370 | A1 * | 9/2010 | Trulaske, Sr. | 49/410 |
| 2011/0094161 | A1 * | 4/2011 | Rees | 49/260 |
| 2011/0179718 | A1 * | 7/2011 | Martin et al. | 49/413 |
| 2012/0073768 | A1 * | 3/2012 | Sawada | 160/370.21 |
| 2014/0173990 | A1 * | 6/2014 | Schachter et al. | 49/404 |
| 2014/0260009 | A1 * | 9/2014 | Ball et al. | 52/207 |

* cited by examiner

*Primary Examiner* — Jerry Redman

(74) *Attorney, Agent, or Firm* — Foley & Lardner LLP

(57) ABSTRACT

A shower door assembly includes a frame having an upper frame member that is elongated with a generally constant cross-section. The cross-section of the frame member may define a channel. The shower door assembly also includes a door that slides in a direction parallel with the channel, as well as a bumper. The bumper is positioned within the channel of the upper frame member and limits movement of the door. The bumper is connected to the upper frame member by the upper frame member compressing a portion of the bumper, or the bumper compressing a portion of the upper frame member, or both.

20 Claims, 11 Drawing Sheets

SHOWER DOOR BUMPER

CROSS-REFERENCE TO RELATED PATENT APPLICATIONS

This application claims the benefit of U.S. Provisional Application No. 61/874,785, filed Sep. 6, 2013, which is incorporated herein by reference in its entirety.

BACKGROUND

The present disclosure is directed to a shower door assembly and, in particular, a sliding shower door assembly having a bumper.

A sliding shower door assembly may include a bumper that is configured to prevent impact between a shower door and a stationary, structural object, such as a wall or other structural member of a bathroom or shower enclosure. Conventional bumpers are typically mounted either to a vertical surface that the shower door might otherwise engage, or are coupled to a vertical edge of the door itself. Such a bumper may, for example, be coupled using threaded or specialized fasteners and/or adhesive, which creates complexity to assembly and installation of the shower door assembly by requiring additional labor, tools, time, and knowledge, and also adds difficulty to replacing the bumper. Furthermore, bumpers are typically mounted within plain sight of a bather and can contribute to undesirable aesthetics.

SUMMARY

According to an exemplary embodiment, a shower door assembly generally includes a frame, a door, and a bumper. The frame includes an upper frame member that is elongated and has a generally constant cross-section defining a channel therein. The door is configured to slide in a direction parallel with the channel. The bumper member is positioned generally within the channel of the upper frame member and is configured to limit movement of the door. The bumper member is coupled directly to the upper frame member by the upper frame member compressing at least a portion of the bumper member, or the bumper member compressing at least a portion of the upper frame member, or both.

According to another exemplary embodiment, a shower door assembly generally includes a frame, a door, and a bumper member. The frame includes an upper frame member that is elongated. The door is configured to slide along a path defined by the upper frame member. The bumper member includes a first surface and a second surface facing away from the first surface. The bumper is directly coupled to the upper frame member. The second surface of the bumper member is positioned adjacent to a stationary surface of a structure that is separate from and that is coupled to the upper frame member. The door is configured to slide into engagement with the first surface of the bumper member to compress the bumper member against the stationary surface.

According to yet another exemplary embodiment, a shower door assembly generally includes a frame, one or more doors, and a bumper. The frame includes a header. The one or more doors are supported by and slide parallel with the header. The bumper is coupled to the header. The bumper is press-fit into the header and is compressed by the header in a direction that is horizontal and transverse to movement of the door. The bumper is not compressed in a vertical direction by the header.

DETAILED DESCRIPTION

Figure 1:
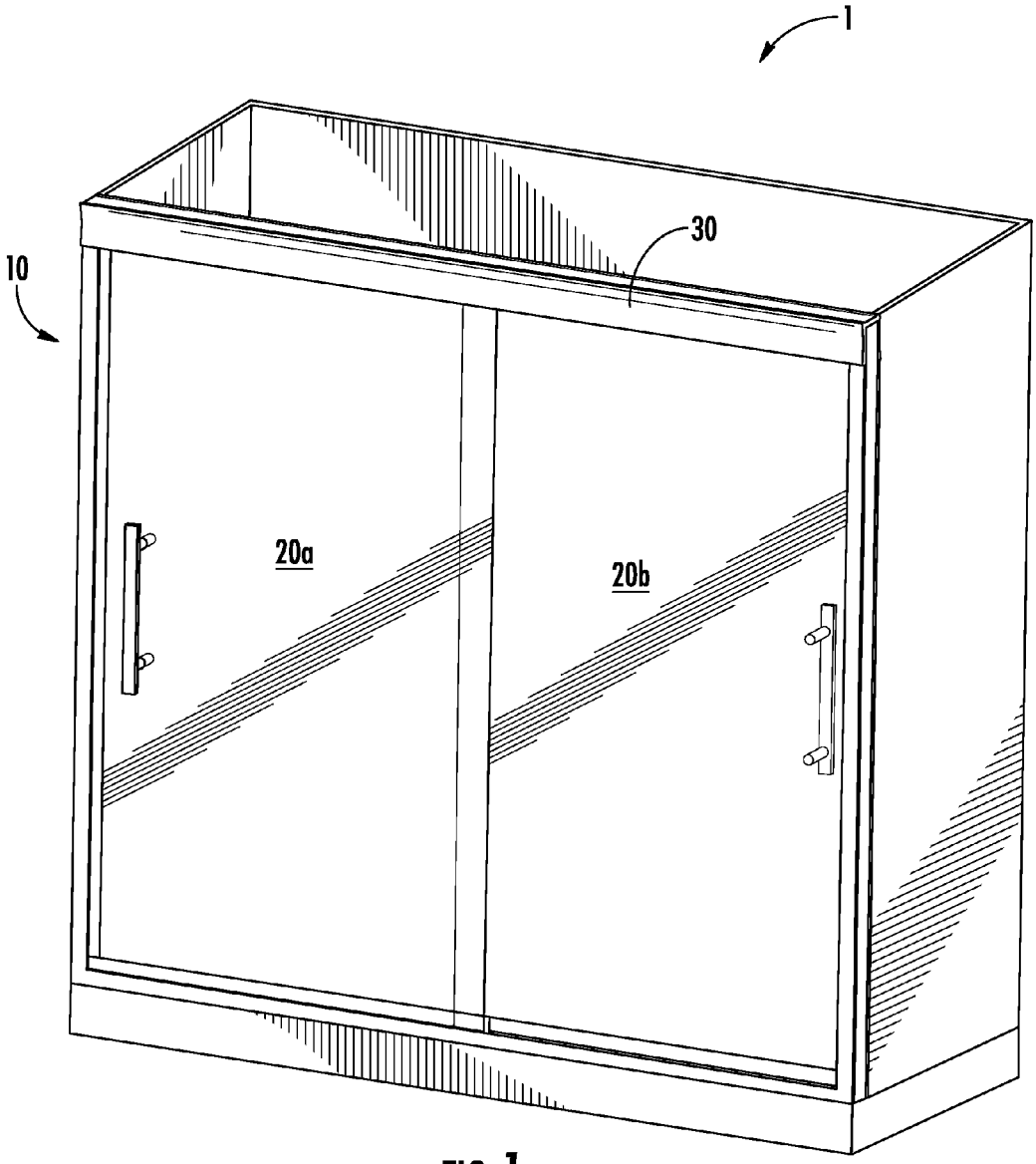
FIG. 1 is a perspective view of a shower enclosure having a shower door assembly according to an exemplary embodiment.

Referring generally to the FIGURES, disclosed herein is an exemplary embodiment for a sliding shower door assembly having a frame, one or more sliding doors, and a bumper member. The bumper member is coupled to an upper member of the frame with a press-fit relationship to overcome the aforementioned complexities associated with installation and/or replacement of conventional shower door bumpers. Furthermore, the bumper member may be positioned generally within the upper member to be at least partially hidden from view of a bather, so as to improve visual aesthetics as compared to previous shower door assemblies.

Referring to FIGS. 1-4, according to an exemplary embodiment, a bathing enclosure 1 includes a shower door assembly 10 having one or more doors 20*a*, 20*b*, and a frame 30 with one or more bumper members 60 (e.g., bumper, stop, etc.) coupled thereto. The one or more doors 20*a*, 20*b* are configured to move translationally (e.g., slide, roll, etc.) in parallel with, and being guided by, the frame 30 until reaching or impacting the bumper member 60.

As shown in FIG. 1, according to an exemplary embodiment, the doors 20*a*, 20*b* are generally planar, such as a panel of glass, or other generally rigid material or combinations, and may or may not (as shown) include a frame therearound. While the doors 20*a*, 20*b* are depicted as bypass sliding doors (i.e., both of which move and may slide past each other), other door configurations are contemplated including, for example, one single door or multiple sliding doors that do not slide past each other.

According to an exemplary embodiment, the frame 30 provides structural support for the doors 20*a*, 20*b*. The frame 30 also guides the doors 20*a*, 20*b* as they are moved by a bather to open and close the bathing enclosure 1. The frame 30 may be coupled to a structure of a building (e.g., floor, wall, ceiling, joists, etc.) and/or other stationary portions of the bathing enclosure 1 (e.g., shower receptor, tray pan, bathtub, wall panels, etc.). The frame 30 may also provide for water management of the enclosure 1 (e.g., to prevent water from escaping the shower enclosure).

Figure 2:
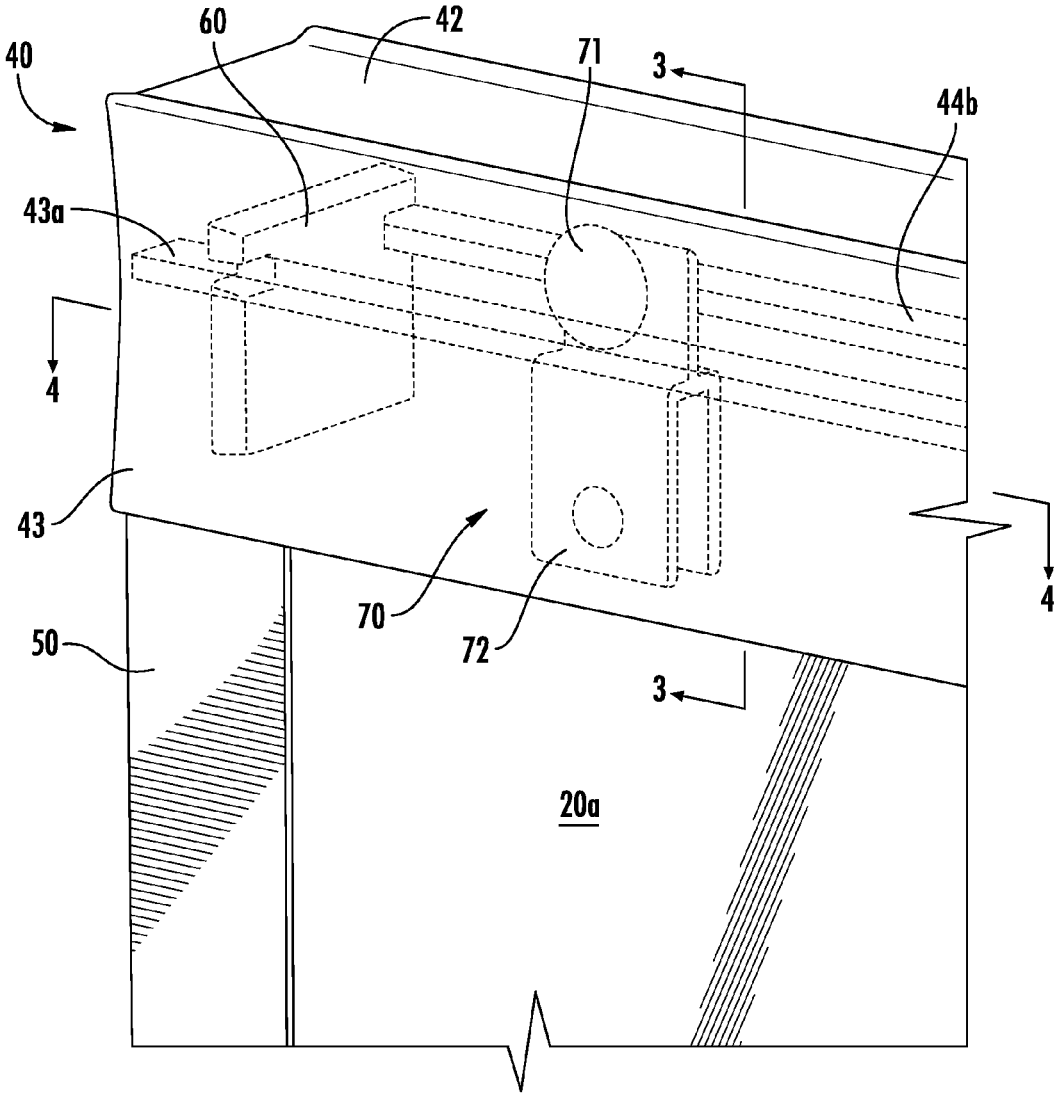
FIG. 2 is a partial perspective view of the shower door assembly shown in FIG. 1.
Figure 3:
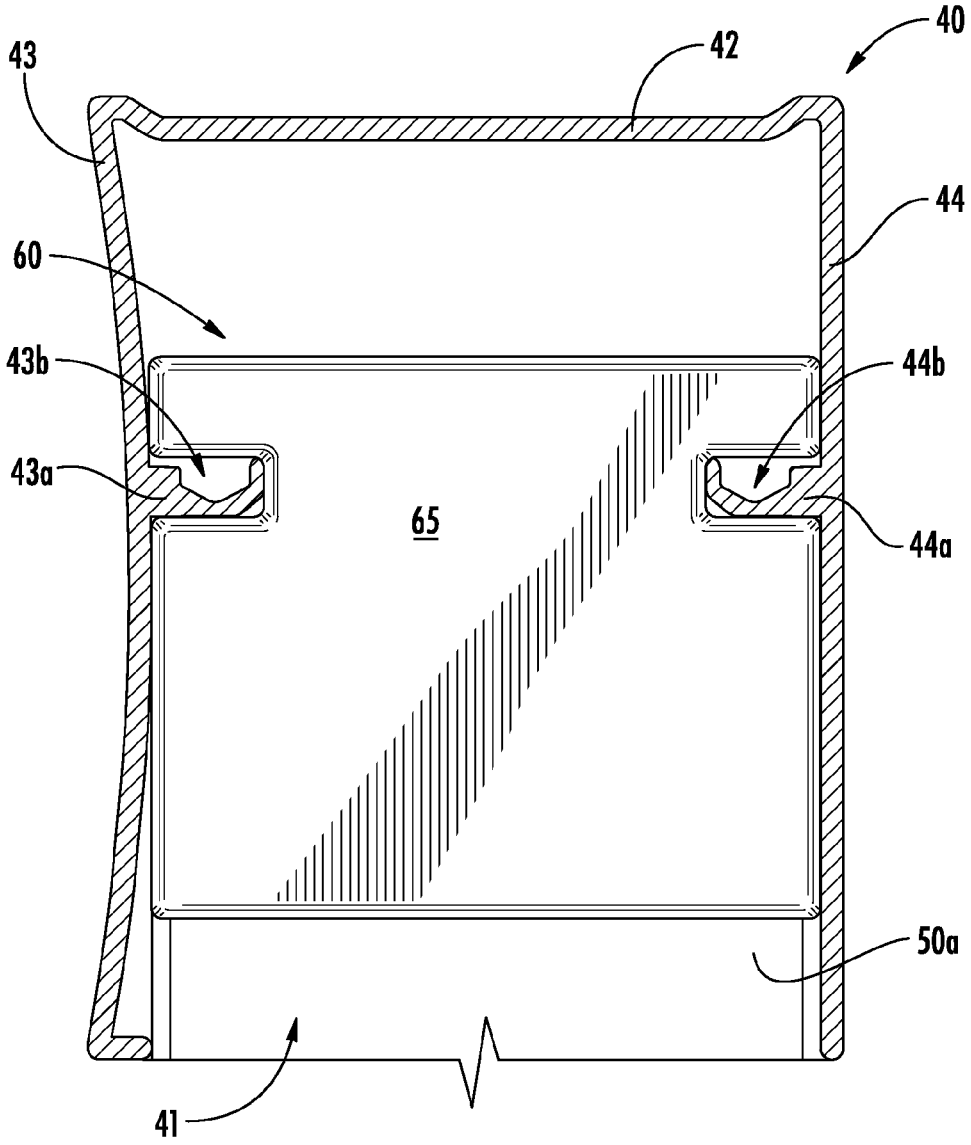
FIG. 3 is a cross-sectional view of the shower door assembly taken along Line 3-3 in FIG. 1 with the shower door out of view.
Figure 4:
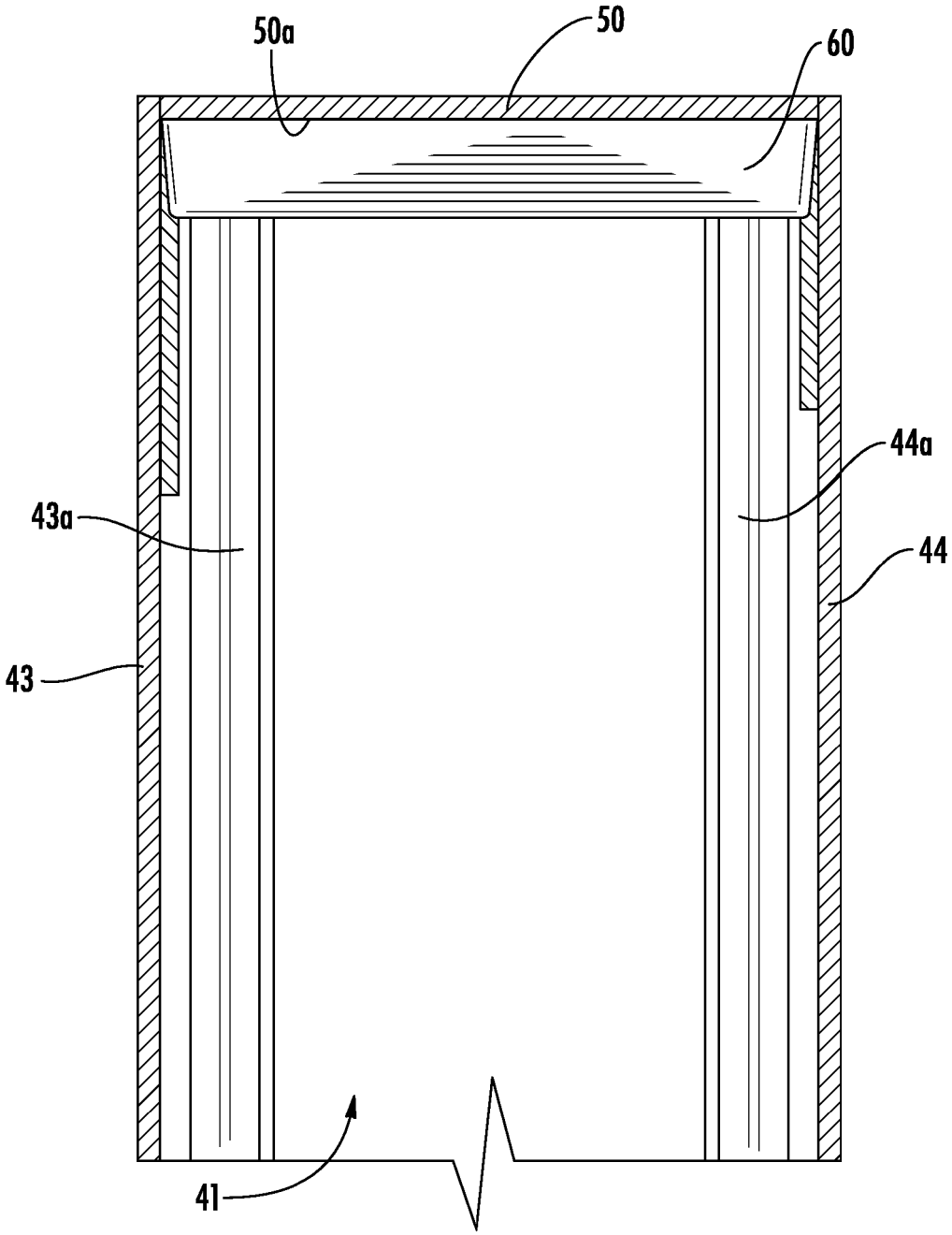
FIG. 4 is a cross-sectional view of the shower door assembly taken along Line 3-3 in FIG. 1 with the shower door out of view.

Referring to FIGS. 2-3, according to an exemplary embodiment, the frame 30 generally includes an upper, elongate frame member 40 (e.g., header, rail, etc.) and two side, upright elongate frame members 50 (e.g., jamb, post, rail, etc.).

According to an exemplary embodiment, one of the upright frame members 50 is positioned on each side of the entry and extends upward from a portion of the shower receptor (e.g., threshold, curb, etc.) or bathtub (e.g., front wall, rim, etc.). The upright frame members 50 may each be coupled at a lower end thereof to the receptor or bathtub and/or to a structure of the building (e.g., in an alcove installation) or enclosure 1 (e.g., with fasteners, adhesive, and/or sealant materials).

According to an exemplary embodiment, the upper frame member 40 extends across the entry into the shower enclosure and is positioned, for example, above the threshold of the receptor or the front wall of the bathtub. The upper frame member 40 is coupled to upper ends of the upright frame members 50 to be supported above the entry.

According to other exemplary embodiments, the frame 30 may be configured in other manners. For example, the upright frame members 50 may instead or additionally be coupled at intermediate portions to the structure of the building or the enclosure 1, the upper frame member 40 may be instead or additionally be coupled to a structure of a home or building (with or without being supported by the upright frame members 50), the frame 30 may further include a lower, elongate frame member coupled to the upright frame members 50 and/or the shower receptor or bathtub (e.g., along the curb of the receptor or rim of the bathtub), and/or the frame 30 may not include the upright members 50 (i.e., the upper frame member 40 being coupled to and supported by structures of the building or enclosure 1).

According to an exemplary embodiment, the one or more doors 20*a*, 20*b* are each configured move translationally (e.g., slide, roll, etc.) within a generally horizontal path defined by the frame 30 and, in particular, by the upper frame member 40. The one or more doors 20*a*, 20*b* and upper frame member 40 may be further cooperatively configured, such that the doors 20*a*, 20*b* are suspended by the upper frame member 40, for example, with one or more slide assemblies or mechanisms 70.

According to an exemplary embodiment, each slide assembly 70 includes a slider 71 (e.g., wheel, roller, or low friction material) and an arm 72 (e.g., extension, member, etc.). The slider 71 movably engages (e.g., by rolling or sliding across), and may also be received within, the upper frame member 40. The arm 72 extends downward from the slider 71 and is coupled to one of the doors 20*a*, 20*b*.

According to an exemplary embodiment, the upper frame member 40 provides lateral support for the one or more doors 20*a*, 20*b* by preventing the upper ends of the doors 20*a*, 20*b* from being pushed rearward into the shower enclosure and/or forward away from the shower enclosure (i.e., forward being defined as the direction facing a bather prior to entry into the shower enclosure, and rearward being defined as the direction facing a bather positioned in the enclosure). For example, the arm 72 of the slider assembly 70 and/or an upper end of the doors 20*a*, 20*b* may be received and slide within a portion of the upper frame member 40. According to other exemplary embodiments, the doors 20*a*, 20*b* may not be suspended by the upper frame member 40, while the upper frame member 40 still provides lateral support.

According to one exemplary embodiment, the upper frame member 40 has a generally constant cross-sectional shape extending between a first end and a second end. The upper frame member 40 defines a generally U-shaped, downwardly open channel 41 in which the slide mechanism 70 of the one or more doors 20*a*, 20*b* is received, such that the doors 20*a*, 20*b* slides generally parallel with the channel 41. The upper frame member 40 includes an upper segment 42 (e.g., intermediate), a first or forward flange 43 (e.g., segment, extension, etc.) extending downward from the upper segment 42, and a second or rearward flange 44 (e.g., segment, extension, etc.) extending downward from the upper segment 42 that is spaced apart from the forward flange 43. The channel 41 is thus defined generally between the upper segment 42, forward flange 43, and rearward flange 44.

According to an exemplary embodiment, the forward flange 43 and rearward flange 44 are spaced apart so as to receive therebetween (i.e., within the channel 41) a portion of the slide assembly 70 and/or upper ends of the doors 20*a*, 20*b*. For example, the forward flange 43 may extend downward with a curvature bowing into the channel 41 (i.e., the channel 41 is slightly concave when viewed in cross-section) and the rearward flange 44 may extend straight downward from the upper segment 42 (e.g., at approximately a 90 degree angle). Configured in this manner, the forward flange 43 and rearward flange 44 have varying spacing therebetween at different elevations. According to another exemplary embodiment, the forward flange 43 and rearward flange 44 may, for example, extend generally vertical downward, so as to have generally constant spacing therebetween at different elevations. According to other exemplary embodiments, the forward flange 43 and rearward flange 44 may each be configured in other manners, including, for example by extending downward in a non-vertical direction, by not having generally constant spacing therebetween, and/or by being provided by separate upper frame members 40.

According to an exemplary embodiment, the upper frame member 40 is configured to suspend the one or more doors 20*a*, 20*b* (e.g., by way of the slider mechanisms 70) from within the channel 41. For example, the upper frame member 40 may include one or more inner tracks 43*a*, 44*a* configured to slidably receive thereon the slider 71 of the slide assembly 70. More particularly, a first or forward track 43*a* is an intermediately-positioned, inwardly-extending flange 43*a* (e.g., track, ledge, segment, etc.) that is coupled to and extends rearward from an intermediately-positioned portion (i.e., intermediate elevation) of the forward flange 43. A second or rearward track 44*a* is an intermediately-positioned, inwardly extending flange 44*a* (e.g., track, ledge, segment, etc.) that is coupled to and extends forward from an intermediately-positioned portion (i.e., intermediate elevation) of the rearward flange 44. The forward track 43*a* and rearward track 44*a* are spaced-apart and positioned across from each other, so as to allow the arms 71 of the sliding mechanisms 70 pass each other as the doors 20*a*, 20*b* are moved. The forward track 43*a* and rearward track 44*a* may further include a groove or recess 43*b*, 44*b*, respectively, in which the slider 71 is received, so as to prevent forward and/or rearward movement of the slide assemblies 70 and/or doors 20*a*, 20*b* relative to the upper frame member 40. According to other exemplary embodiments, the upper frame member 40 is configured to slidably receive and suspend only one door (or multiple doors that do not bypass each other) and includes only one track 43*a* or 43*b*.

According to an exemplary embodiment, the upper frame member 40 and upright members 50 are each a unitary (i.e., integrally formed as a single, continuous member), extruded aluminum member. According to other exemplary embodiments, the upper frame member 40 and/or upright members 50 are formed from multiple subcomponents (e.g., the forward track 43*a* and rearward track 44*a* are separately formed and are coupled to a U-shaped channel), other manufacturing processes (e.g., stamping, casting, rolling, etc. alone or in combination with extruding and/or each other), and/or other materials (e.g., other metals, such as stainless steel, polymers, composites, etc.), and the like.

Referring to FIGS. 2-5D, according to an exemplary embodiment, the shower door assembly 10 includes one or more bumper member(s) 60 (e.g., stop, bumper, etc.). Each bumper member 60 is configured to prevent the one or more doors 20*a*, 20*b* from direct contact and/or impact with one of the upright frame members 50 or, in embodiments without upright frame members 50, with a structure or surface of the building or enclosure 1. Thus, the bumper member 60 advantageously protects the doors 20*a*, 20*b*, which may be made from a relatively fragile material (e.g., glass), from breaking More particularly, each bumper member 60 is a generally planar, resilient polymeric (e.g., elastomeric) member. The bumper member 60 includes a first or receiving surface 65 that is configured to receive there against (e.g., engage, impact, contact, etc.) an upper corner portion (e.g., end, edge, etc.) of the doors 20*a*, 20*b* as each is moved. The bumper member 60 further includes a second or abutting surface 66 that faces away from the first surface and is statically positioned adjacent to or bears against a surface (i.e., structural surface 50*a*) of the upright frame member 50, or of the building structure or enclosure 1, that would otherwise be impacted by the doors 20*a*, 20*b* when moved. According to one exemplary embodiment, the first and second surfaces 65, 66 of the bumper member 60 are generally planar and parallel with each other, such that the bumper member 60 has a generally constant thickness. When positioned within the upper frame member 40, the first surface 65 of the bumper member 60 is generally perpendicular to the direction of travel of the doors 20*a*, 20*b* as guided by the upper frame member 40. According to other exemplary embodiments, the bumper member 60 is configured to receive there against a portion of the slide assembly 70 instead, or in addition to, the door 20*a* or 20*b* to which the slide assembly 70 is coupled.

While the first and second surfaces 65, 66 of the bumper member 60 are depicted as being planar and parallel, according to other exemplary embodiments, the first and second surfaces 65, 66 of the bumper member 60 may have different configurations (e.g., non-planar contours, non-parallel relationships, etc.), for example, to accommodate differently-shaped structural surfaces (e.g., if the upright frame member 50 has a curved cross-sectional profile), differently-shaped door edge surfaces that impact the receiving surface of the bumper member 60, and/or for different dynamic characteristics (e.g., varying thickness to provide a varying spring constant with greater compression of the bumper member 60).

According to an exemplary embodiment, each bumper member 60 is configured to be coupled to the upper frame member 40, such that the second surface 66 of the bumper member 60 is held adjacent to, or bears against, the structural surface 50*a* (i.e., a surface of the upright frame member 50, or structure of the building or enclosure 1) without being attached to, or connected directly to, the structural surface.

According to an exemplary embodiment, each bumper member 60 is configured to be coupled to the upper frame member 40 with a press-fit relationship with at least a portion of the bumper member 60 being compressed by the upper frame member 40, or at least a portion of the upper frame member 40 being compressed by the bumper member 60, or both. According to another exemplary embodiment, portions of the bumper member 60 may be forced in tension when the bumper member 60 is coupled to the frame member 40. As used herein, the terms "compress," "compressed," "compressing," "tension" and similar refer to applying compressive forces and tensional forces to a member or object with or without the object or member being deformed due to the compressive/tensional forces applied thereto. Configured in this manner, the bumper member 60 may be installed (i.e., coupled to the frame 30) without the use of separate fasteners, adhesives, or related tools and may further be easily removed for easy replacement (i.e., is releasably coupled).

According to various exemplary embodiments, the friction between the bumper member 60 and the upper frame member 40 (i.e., based on the coefficient of friction, interface area, and compressive/tensional forces in a direction transverse to movement of the door) would be insufficient, by itself, to prevent movement of the doors 20*a*, 20*b*. That is, the doors 20*a*, 20*b* would be able to move the bumper 60 relative to the upper frame member 40 if the bumper member 60 was not supported horizontally by an upright structural surface positioned on a side of the bumper member 60 opposite the doors 20*a*, 20*b*. For example, as shown in the figures, the peripheral surfaces of the bumper member 60 (i.e., thickness of the bumper member 60 as measured between the first and second surfaces 65, 66) are relatively narrow compared to the width of the first surface 65 (as measured, e.g., between first and second peripheral surfaces 61, 62 shown in FIG. 5C) of the bumper member 60 that is configured to be engaged by the doors 20*a*, 20*b* (e.g., thickness of less than approximately one fourth the width). According to other exemplary embodiments, the friction between the bumper member 60 and the frame member 40 is sufficient to prevent movement of the doors 20*a*, 20*b* without horizontal support by an upright structural surface. For example, the peripheral surfaces of the bumper member 60 is greater than the width of the first surface 65 of the bumper member 60, so as to increase the interface area, and thereby the friction, between the bumper member 60 and the upper frame member 40 (e.g., greater than approximately one times the width).

According to an exemplary embodiment, as shown in FIG. 3, the bumper member 60 is configured to be received within the channel 41 of the upper frame member 40. The bumper member 60 has a shape (e.g., outer profile, or periphery) that is complementary to a shape (e.g., inner profile or periphery) of the channel 41 of the upper frame member 40. For example, the bumper member 60 includes a first or forward peripheral edge or surface 61 that extends between the first and second surfaces 65, 66 of the bumper member 60, and a second or rearward peripheral edge or surface 62 that extends between the first and second planar surfaces of the bumper member 60. The forward peripheral surface 61 and the rearward peripheral surface 62 are spaced apart nominally. Configured in this manner, the bumper member 60 may be press-fit into the channel 41 of the upper frame member 40 to be coupled thereto. That is, the bumper member 60 is compressed in a direction that is transverse (e.g., generally normal or perpendicular) to the direction of travel of the doors 20*a*, 20*b* (e.g., horizontally in the forward/rearward direction) between the forward flange 43 and the rearward flange 44 of the upper frame member 40. According to some exemplary embodiments, upper and lower peripheral surfaces of the bumper member 60 do not engage inner surfaces of the upper frame member 40, such that the bumper member 60 is not compressed in a vertical direction by the upper frame member 40, while in still other exemplary embodiments, the upper and lower peripheral surfaces of the bumper member 60 do engage inner surfaces of the upper frame member 40, such that the bumper member 60 is compressed in a vertical direction (e.g., between the upper segment 42 and the first and/or second tracks 43*a*, 44*a*). According to other exemplary embodiments, the upper and lower peripheral surfaces of the bumper member 60 do engage inner surfaces of the upper frame member 40.

Figure 5A:
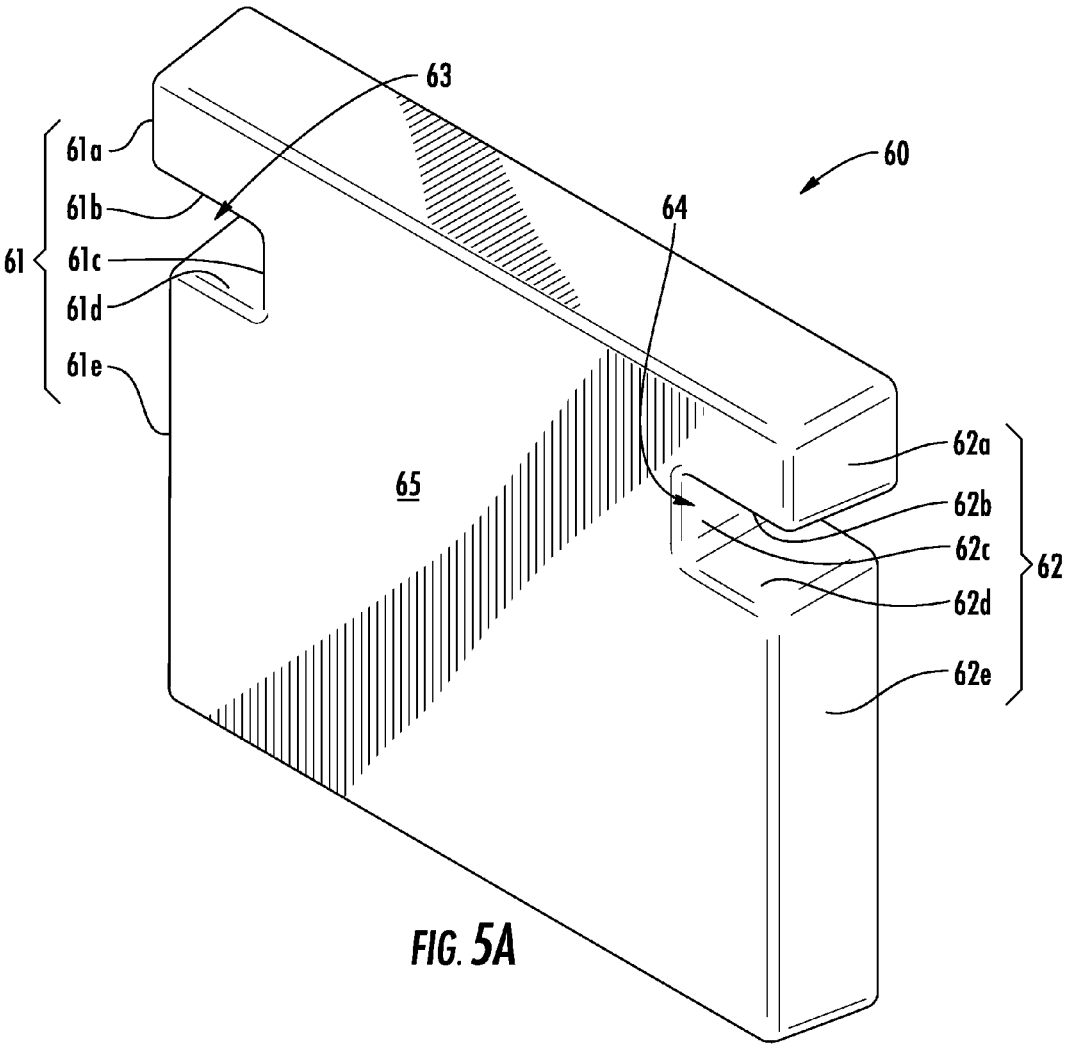
FIG. 5A is a perspective view of a bumper member of the shower door assembly shown in FIG. 1.
Figure 5B:
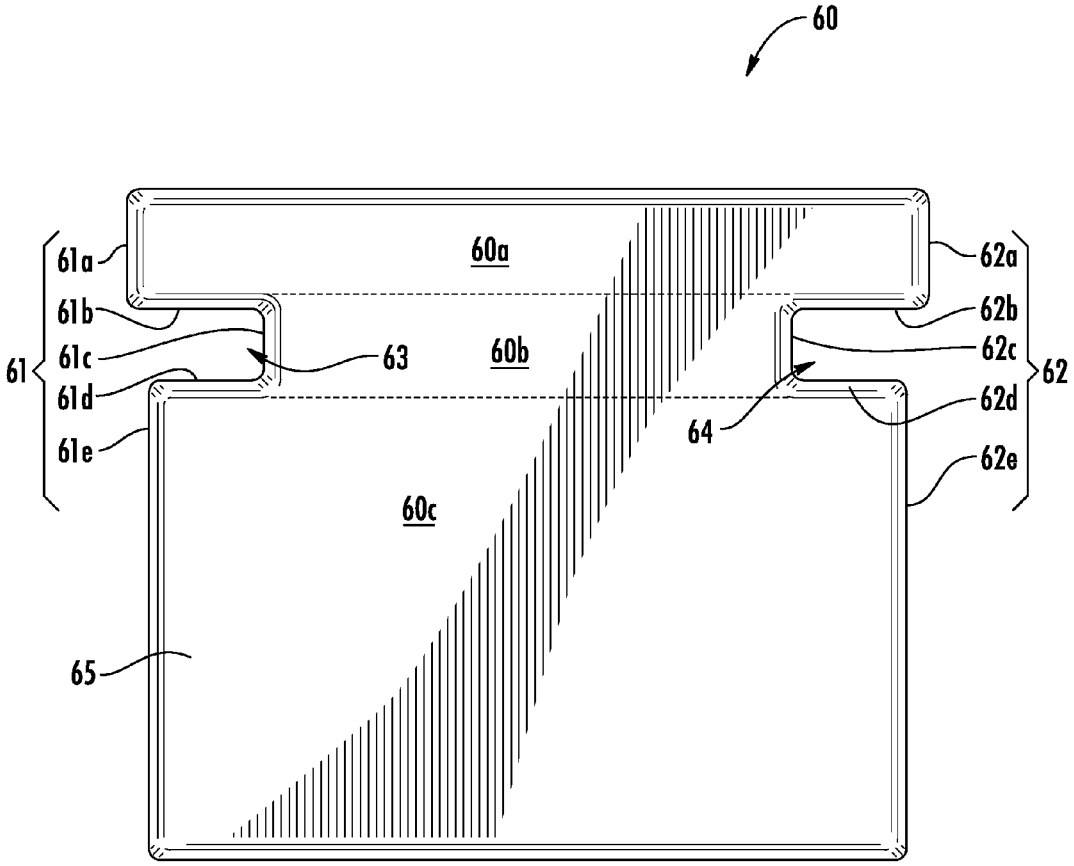
FIG. 5B is a right plan view of the bumper member shown in FIG. 5A.
Figure 5C:
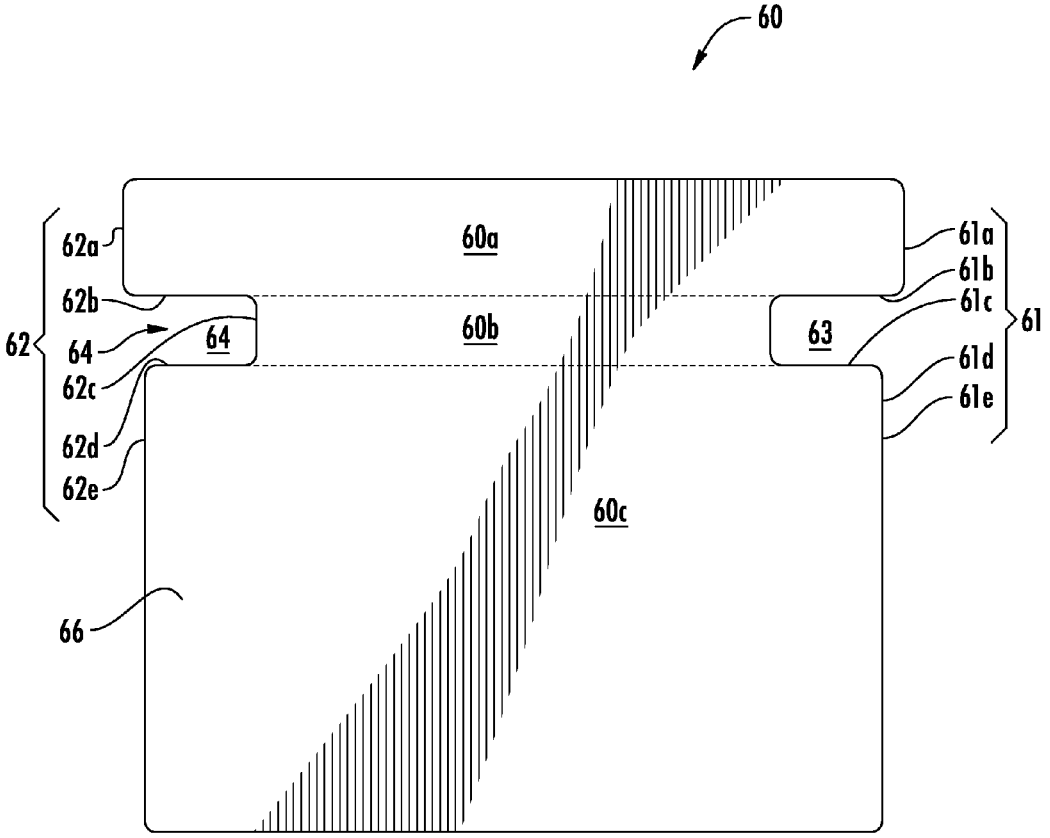
FIG. 5C is a left plan view of the bumper member shown in FIG. 5A.

Referring to FIGS. 5A-5C, according to an exemplary embodiment, the bumper member 60 includes a first or forward slot 63 (e.g., recess, indentation, etc.) that extends inward or rearward from a portion of the forward peripheral surface 61 of the bumper member 60 and may instead, or additionally, include a second or rearward slot 64 (e.g., recess, indentation, etc.) that extends inward or forward from a portion of the rearward peripheral surface 62 of the bumper member 60. Configured in this manner, as shown in FIGS. 5A-5C, the bumper member 60 generally includes an upper portion 60*a* above the slots 63, 64, an intermediate portion 60*b* extending in a generally horizontal direction between the slots 63, 64, and a lower portion 60*c* generally below the slots 63, 64. Furthermore, the forward peripheral surface 61 includes an upper, upright portion 61*a* extending upward from the slot 63, an upper, lateral portion 61*b* extending inward above the slot 63, an inner/intermediate, upright portion 61*c* extending downward inward of the slot 63, a lower, lateral portion 61*d* extending inward below the slot 63, and a lower, upright portion 61*e* extending downward from the slot 63. Similarly, the rearward periphery 62 includes an upper, upright portion 62*a* extending upward from the slot 64, an upper, lateral portion 62*b* extending inward above the slot 64, an inner/intermediate, upright portion 62*c* extending downward inward of the slot 64, a lower, lateral portion 62*d* extending inward below the slot 64, and a lower, upright portion 62*e* extending downward from the slot 64.

According to an exemplary embodiment, the forward slot 63 of the bumper member 60 is configured to receive the forward track 43*a* of the upper frame member 40, and the rearward slot 64 of the bumper member 60 is configured to receive the rearward track 44*a* of the upper frame member 40. Configured in this manner, the upper portion 60*a* and the lower portion 60*c* of the bumper member are configured to engage the forward track 43*a* and rearward track 44*a*, so as to limit vertical movement of the bumper member 60 relative to the upper frame member 40, and the intermediate portion 60*b* of the bumper member is configured to engage the forward and rearward tracks 43*a*, 44*a*, so as to limit horizontal movement of the bumper member 60 relative to the upper frame 40. According to other exemplary embodiments in which the upper frame member 40 includes only one of the tracks 43*a*, 44*a*, the bumper member 60 may include only one of the slots 63, 64, or may still include both slots 63, 64.

Furthermore, each of the slots 63, 64 may be offset or biased toward an upper end of the bumper member 60, such that the lower portion 60*c* of the bumper has a greater height than a distance between the forward track 43*a* and/or rearward track 44*a* and the upper segment 42. In this manner, the bumper member 60 can be installed in the frame member 40 with only one vertical orientation (i.e., about a horizontal plane extending through the bumper member 60). According to other exemplary embodiments, the slots 63, 64 may be approximately centered along the height of the bumper member 60, or offset toward a lower end of the bumper member 60.

According to an exemplary embodiment, the upper portion 60*a* of the bumper member 60 is configured to be press-fit into the upper frame member 40. More particularly, the upper portion 60*a* of the bumper member 60 has an uncompressed width (i.e., the spacing between the upper, upright portion 61*a* of the forward peripheral surface 61 of the bumper member 60 and the upper, upright portion 62*a* of the rearward peripheral surface 62) that is greater than the spacing between the first flange 43 and second flange 44 of the upper frame member 40 at corresponding elevations (e.g., those above the first and second tracks 43*a*, 43*b*). Configured in this manner, the upper portion 60*a* of the bumper member 60 is compressed in a direction that is transverse (e.g., generally normal, or perpendicular) to the direction of travel of the doors 20*a*, 20*b* (e.g., compressed in a generally horizontal forward/rearward direction). For example, as shown in FIGS. 5A-5C, the upper portion 60*a* of the bumper member 60 may have a generally constant width (e.g., extending parallel downward from an upper portion of the peripheral surface of the bumper member 60) at different heights or elevations thereof regardless of whether the first and second flanges 43, 44 of the upper frame member 40 have constant spacing therebetween at corresponding heights or elevations. According to other exemplary embodiments, the upper portion 60*a* of the bumper member 60 may have a varying width at different heights or elevations thereof, for example, being tapered or contoured in manners corresponding to the profile of corresponding portions of the first and second flanges 43, 44.

According to an exemplary embodiment, the lower portion 60*c* of the bumper member 60 is configured to be press-fit into the upper frame member 40. More particularly, the lower portion 60*c* of the bumper member 60 has an uncompressed width (i.e., the spacing between the lower, upright portion 61*e* of the forward peripheral surface 61 of the bumper member 60 and the lower, upright portion 62*e* of the rearward peripheral surface 62) that is greater than the spacing between the first flange 43 and second flange 44 of the upper frame member 40 at corresponding elevations (e.g., those below the first and second tracks 43*a*, 44*a*). Configured in this manner, lower upper portion 60*c* of the bumper member 60 is compressed in a direction that is transverse (e.g., generally normal, or perpendicular) to the direction of travel of the doors 20*a*, 20*b* (e.g., compressed in a generally horizontal forward/rearward direction). For example, the lower portion 60*c* of the bumper member 60 may have a generally constant width (e.g., extending parallel upward from a lower portion of the peripheral surface of the bumper member 60) at different heights or elevations thereof regardless of whether the first and second flanges 43, 44 of the upper frame member 40 have constant spacing therebetween at corresponding heights or elevations. According to other exemplary embodiments, the lower portion 60*c* of the bumper member 60 may have a varying width at different heights or elevations thereof, for example, being tapered or contoured in manners corresponding to the profile of corresponding portions of the first and second flanges 43, 44.

According to an exemplary embodiment, the width of the lower portion 60*c* of the bumper 60 is less than the width of the upper portion 60*a*. Differing widths may, for example, accommodate different spacing between corresponding portions of the first and second flanges 43, 44 and/or may provide for different compressive forces applied to the upper and lower portions 60*a*, 60*c* of the bumper 60 by the upper frame member 40. Furthermore, the respective widths of either or both the upper and lower portions 60*a*, 60*c* may be less than the spacing between the first and second flanges 43, 44 at corresponding elevations, such that either or both the upper and lower portions 60*a*, 60*c* do not engage and/or are not compressed by the flanges 43, 44. According to other exemplary embodiments, the upper and lower portions 60*a*, 60*c* have the same widths.

According to an exemplary embodiment, the bumper member 60 is configured to compress at least a portion of the forward track 43*a* and/or the rearward track 44*a* between the upper portion 60*a* and lower portion 60*c* of the bumper member 60 in the slot 63 and/or slot 64, respectively. The forward slot 63 has a height or spacing (i.e., between the upper, lateral portion 61*b* of the forward peripheral surface 61 and the lower, lateral portion 61*d*) over at least a portion thereof that is nominally, or in a non-deflected state, less than the thickness or height of a corresponding portion of the forward track 43*a*, such that the forward track 43*a* is compressed between the upper portion 60*a* and the lower portion 60*c* of the bumper member 60. Instead, or additionally, the rearward slot 64 has a height or spacing (i.e., between the upper, lateral portion 62*b* of the forward peripheral surface 62 and the lower, lateral portion 62*d*) over at least a portion there of that is in nominally, or in an non-deflected state, less than the thickness of a corresponding portion of the rearward track 44*a*, such that the rearward track 44*a* is compressed between the upper portion 60*a* and the lower portion 60*c* of the bumper member 60 in a generally vertical direction.

According to an exemplary embodiment, portions of the upper and lower portions 60*a*, 60*c* are resilient and configured to be compressed as one or more of the slots 63, 64 are pressed around the forward and/or rearward track(s) 43*a*, 44*a*. For example, the slot(s) 63, 64 may have a height or spacing that is less than the thickness of a corresponding portion of the forward and/or rearward track(s) 43*a*, 44*a*, and as the track(s) 43*a*, 44*a* are pressed into the slot(s) 63, 64, portions of the upper and lower portions 60*a*, 60*c* may be compressed. Thus, the height of the slot(s) 63, 64 is increased or expanded in order to accommodate the track(s) 43*a*, 44*a*.

According to an exemplary embodiment, the intermediate or middle portion 60*b* of the bumper member 60 is configured to be compressed between the forward track 43*a* and the rearward track 44*a* of the upper frame member 40. The forward slot 63 and the rearward slot 64 have a spacing therebetween (i.e., between the intermediate, upright portion 61*c* of the forward peripheral surface 61 of the bumper member 60 and the intermediate, upright portion 62*c* of the rearward peripheral surface 62) over at least portions thereof that is nominally, or in an uncompressed state, greater than a distance between inner ends of the forward track 43*a* and the rearward tack 44*a*, such that the intermediate portion 60*b* of the bumper member 60 is compressed between the forward track 43*a* and the rearward track 44*a* in a generally horizontal direction. That is, the intermediate portion 60*b* of the bumper member 60 is compressed in a direction that is generally normal or perpendicular to the direction of travel of the doors 20*a*, 20*b* (e.g., horizontally in the forward/rearward direction) between the forward track 43*a* and the rearward track 44*a* of the upper frame member 40.

According to an exemplary embodiment, the slots 63, 64 of the bumper member 60 are configured similarly relative to their corresponding peripheral surfaces 61, 62 (i.e., in shape, height, width, positioning and orientation relative to upper and lower edges of the bumper member 60, etc.). Configured in this manner, the bumper member 60 (e.g., the first and/or second surface 65, 66) is generally symmetric about a vertical plane and may be installed into the upper frame member 40, such that either the first or second surface acts as the receiving surface to the doors 20*a*, 20*b*. Advantageously, this allows for bumper members 60 of a single design to be installed on either end of the upper frame member 40 while maintaining proper orientation of the receiving surfaces relative to the doors 20*a*, 20*b*. According to other exemplary embodiments, the slots 63, 64 may have different configurations, which correspond to features of the upper frame member 40 (e.g., profile, tracks 43*a*, 44*a*, etc.), such that the bumper member 60 may be installed within the channel 41 of the upper frame member 40 in only a single orientation. According to still further exemplary embodiments, the bumper 60 may be reversible (e.g., such that the bumper 60 may be installed in the upper frame member 40 for either the first or second surface 65, 66 to receive and engage the edge or corner of one of the doors 20*a*, 20*b*) and/or symmetric about two planes (e.g., two vertical, perpendicular planes when installed) or three perpendicular planes.

Figure 5D:
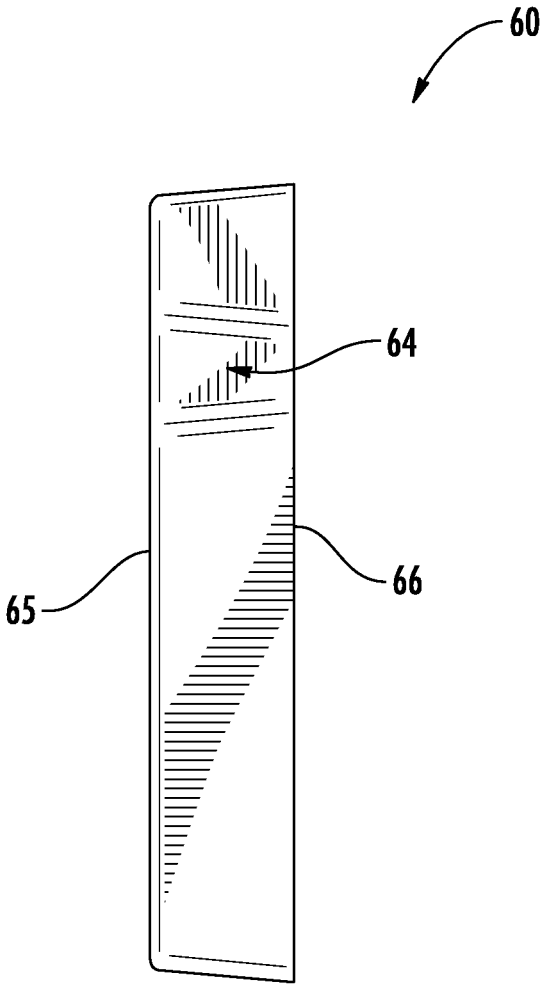
FIG. 5D is a rear plan view of the bumper member shown in FIG. 5A.

As shown in FIG. 5D, the outer peripheral surfaces of the bumper member 60 may also be chamfered or beveled (i.e., extend at non-perpendicular angles relative to the first or second surface 65, 66 of the bumper member 60). For example, as shown, the outer peripheral surfaces (e.g., 61 and 62) extend away from the first surface 65 (i.e., that which is engaged by the door) at an angle that is greater than 90 degrees, such that various portions (e.g., upper, middle, and lower portions 60*a*, 60*b*, 60*c*) of the bumper member 60 have increasing widths at thickness extending toward the second surface 66. The increasing width of the bumper member 60 provides that the first and second peripheral surfaces 61, 62 may engage the first and second flanges 43, 44, which have a constant cross-sectional shape and spacing, with different forces at different thickness or depths of the bumper member 60. For example, according to some exemplary embodiments, the beveled peripheral surfaces may engage/contact the first and second flanges 43, 44 proximate the second surface 66 but does not engage/contact the first and second flanges 43,44 proximate the first surface 65 (i.e., the uncompressed width of the second surface 66 is greater than spacing between corresponding portions of the flanges 43, 44, while the uncompressed width of the first surface 65 is less than the spacing between corresponding portions of the flanges 43, 44). According to other exemplary embodiments, the peripheral surfaces of the bumper member 60 may engage the first and second flanges 43, 44 at all thickness thereof (i.e., the uncompressed widths of the first and second surfaces 65, 66 are both greater than the spacing between the first and second flanges 43, 44 and corresponding portions or elevations thereof). Furthermore, the beveled edge may aid in manufacturing (e.g., removal from a mold).

Figure 6:
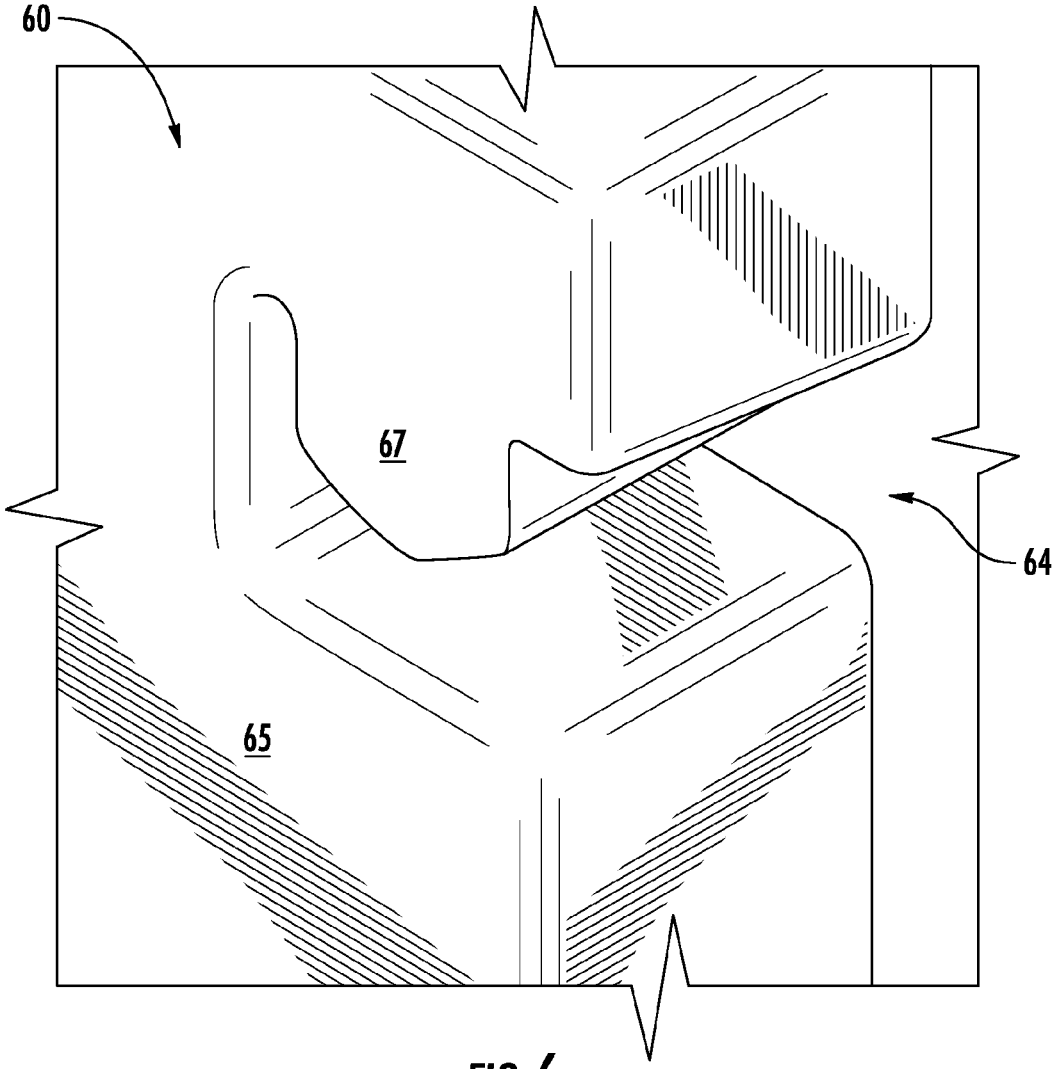
FIG. 6 is a partial perspective view of a bumper member according to another exemplary embodiment.
Figure 7:
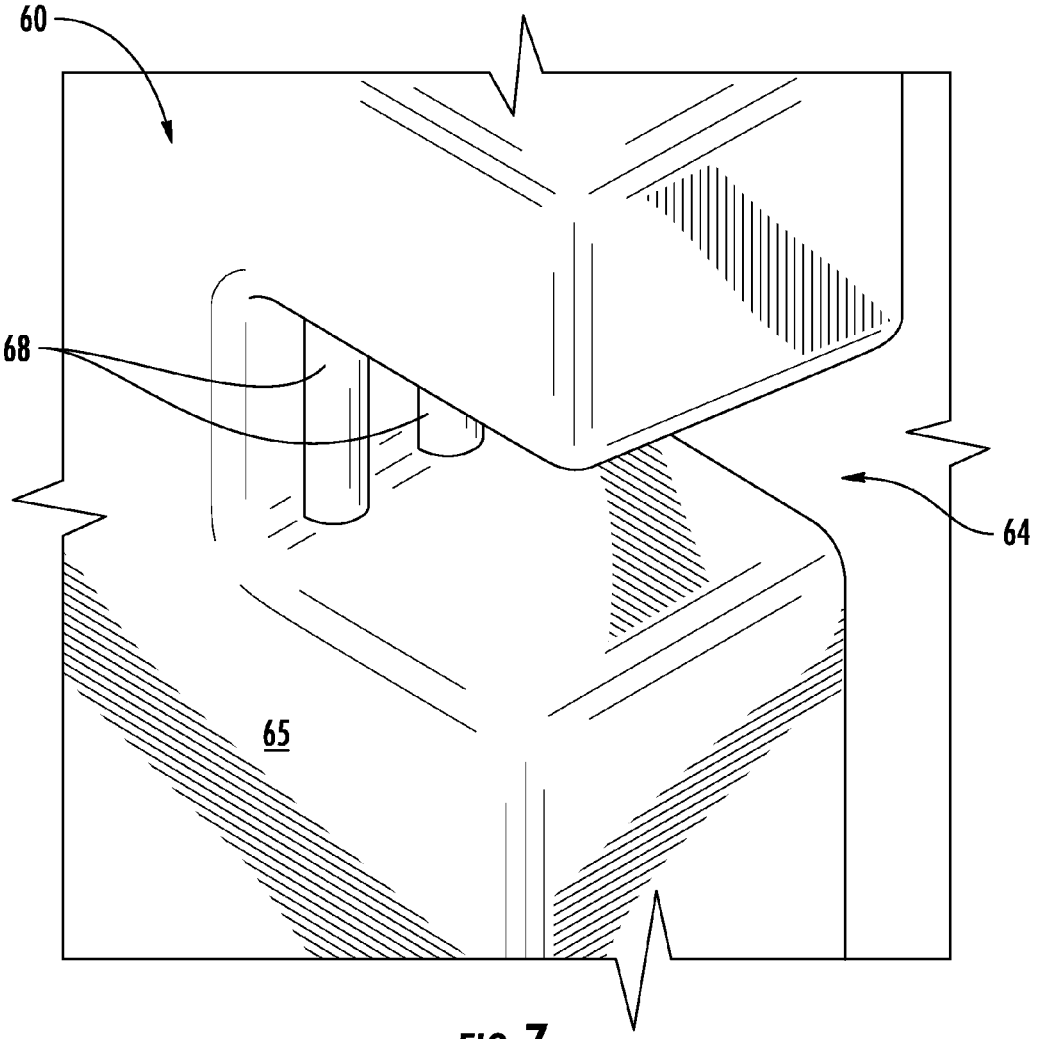
FIG. 7 is a partial perspective view of a bumper member according to another exemplary embodiment.

According to various exemplary embodiments, the bumper member 60 includes additional features that are configured to engage the upper frame member 40. For example, as shown in FIG. 6, the bumper member 60 may include one or more projection(s) 67 that are configured to engage the track(s) 43*a*, 44*a*. More particularly, each projection 67 may have a profile that is complementary to the profile of the groove(s) 43*b*, 44*b* in the track(s) 43*a*, 44*a* (i.e., the projection 67 has a contour that is substantially the same as the groove 43*b*, 44*b*) to be received therein. As another example, as shown in FIG. 7, the bumper member 60 may include one or more ribs 68 (e.g., protrusions, etc.) that extend outward to engage an inner end of the tracks 43*a*, 44*a* of the upper frame member 40.

Figure 8:
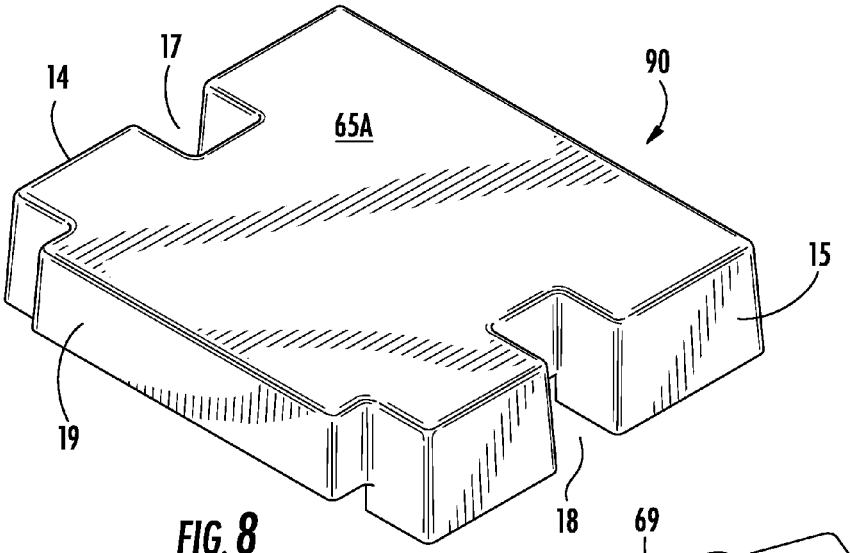
FIG. 8 is a front perspective view of a bumper member according to another exemplary embodiment.
Figure 9:
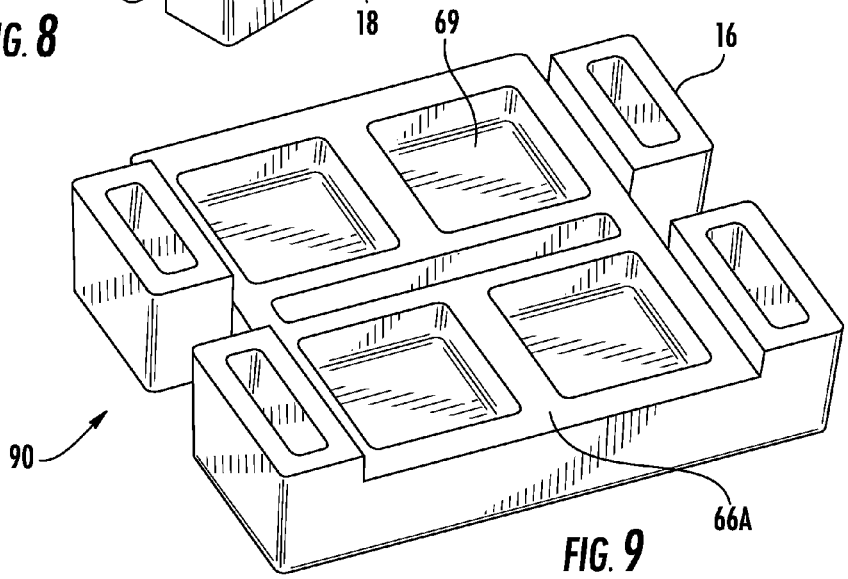
FIG. 9 is a rear perspective view of the bumper member shown in FIG. 8.
Figure 10:
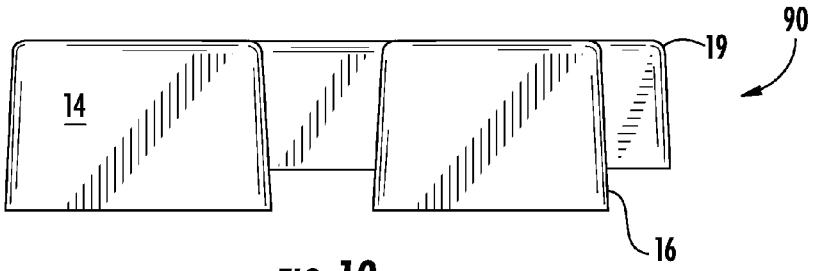
FIG. 10 is a side plan view of the bumper member shown in FIG. 8.

Referring now to FIGS. 8-10, another exemplary embodiment of a bumper member 90 is shown. As shown in FIG. 8, the bumper member 90 includes a first or receiving surface 65*a* that is configured to receive there against (e.g., engage, impact, contact, etc.) an upper corner portion (e.g., end, edge, etc.) of the doors 20*a*, 20*b* as each is moved. For example, when positioned within the upper frame member 40, the first surface 65*a* of the bumper member 90 is generally perpendicular to the direction of travel of the doors 20*a*, 20*b* as guided by the upper frame member 40. According to other exemplary embodiments, the bumper member 90 is configured to receive there against a portion of the slide assembly 70 instead, or in addition to, the door 20*a* or 20*b* to which the slide assembly 70 is coupled. According to one exemplary embodiment, the first surface 65*a* of the bumper member 90 is generally planar.

While the first surface 65*a* of the bumper member 90 is depicted as being planar, according to other exemplary embodiments, the first surface 65*a* of the bumper member 90 may have a different configuration (e.g., non-planar contours, etc.), for example, to accommodate differently-shaped structural surfaces (e.g., if the upright frame member 50 has a curved cross-sectional profile), differently-shaped door edge surfaces that impact the receiving surface of the bumper member 90, and/or for different dynamic characteristics (e.g., varying thickness to provide a varying spring constant with greater compression of the bumper member 90).

Referring now to FIG. 9, the bumper member 90 further includes a second or abutting surface 66*a* that faces away from the first surface 65*a* and is statically positioned adjacent to or bears against a surface (i.e., structural surface 50*a*) of the upright frame member 50, or of the building structure or enclosure 1, that would otherwise be impacted by the doors 20*a*, 20*b* when moved.

According to an exemplary embodiment, the first and second surfaces 65*a*, 66*a* of the bumper member 90 are generally parallel with each other, such that the bumper member 90 has a generally constant thickness. While the first and second surfaces 65*a*, 66*a* of the bumper member 90 are depicted as being generally parallel, according to other exemplary embodiments, the first and second surfaces 65*a*, 66*a* of the bumper member 90 may have different configurations (e.g., non-parallel relationships, etc.).

Referring still to FIG. 9, according to an exemplary embodiment, a plurality of generally square divots 69 (e.g., recesses, depressions, etc.) are disposed within the second surface 66*a* of the bumper member 90. For example, four (4) divots are shown in FIG. 9. According to other exemplary embodiments, the bumper member 90 may include a lesser or greater number of divots 69, and the number of divots 69 disclosed herein is not intended to be limiting. Also, although the divots 69 are depicted as being generally square (with rounded corners), it should be understood that the divots 69 could be configured as having other shapes (e.g., generally circular, oval, etc.), according to other exemplary embodiments. As shown in FIG. 9, the divots 69 are disposed in quadrants within the second surface 66*a*. For example, the divots 69 are provided in a "waffle pattern." According to other exemplary embodiments, the divots 69 may be provided in any suitable pattern within the second surface 66*a*. It should be understood that one or more similar divots may be disposed within either the first surface 65 or the second surface 66 of the bumper member 60. According to still further exemplary embodiments, one or more of the divots 69 may instead be configured as through holes (e.g., extending through the first and second surfaces 65*a*, 65*b*).

According to an exemplary embodiment, one or more fasteners (e.g., a screw, bolt, rivet, etc.) are coupled to the structural surface 50*a* of the frame member 50. In particular, the fasteners are coupled to a portion of the structural surface 50*a* which is adjacent to (e.g., bordered with) the open channel 41. According to an exemplary embodiment, each fastener includes a head which extends intend the open channel 41. According to an exemplary embodiment, one or more divots 69 are coupled to the frame member 50 via one or more fasteners. For example, the divots 69 are configured to be received by a head of each fastener. For example, the fasteners and the divots 69 may be cooperatively configured such that the fasteners may be press-fit within the divots 69. Advantageously, the engagement (e.g., interaction) between the divots 69 and the fasteners maintains the bumper member 90 in a fixed (e.g., stationary) relationship relative to the frame member 50.

Referring further to FIGS. 8-9, according to an exemplary embodiment, a first and second peripheral surface 14, 15 of the bumper member 90 may include one or more ribs 16 (e.g., protrusions, projections, members, extensions, etc.). For example, the first and second peripheral surfaces 14, 15 of the bumper member 90 shown in FIGS. 8-9 each include two (2) ribs 16. Further, a slot 17 may be defined between the two ribs 16 on the first peripheral surface 14 of the bumper, and a slot 18 may be defined between the two ribs 16 on the second peripheral surface 15. According to an exemplary embodiment, the slots 17, 18 may be configured to be coupled to the tracks 43*a*, 44*a* of the first and second flanges 43, 44, respectively. For example, the slots 17, 18 may be configured to couple to the tracks 43*a*, 44*a* in a similar fashion as the slots 63, 64.

Referring now to FIGS. 9-10, according to an exemplary embodiment, the divots 69 may be defined on an upper side by the planar second surface 66*a*. Further, the ribs 16 may extend outwardly from the planar second surface 66*a* (e.g., in a direction away from the first surface 65*a*). For example, an end surface of the ribs 16 may not be coplanar with the second surface 66*a*. According to an exemplary embodiment, the outwardly extending ribs 16 may be configured to engage (e.g., abut against, interact with, etc.) the structural surface 50*a* when the bumper member 90 is coupled to the frame member 40. According to an exemplary embodiment, the ribs 16 include a hollow portion opposite the first surface 65*a*. According to another exemplary embodiment, the ribs 16 do not include a hollow portion. According to an exemplary embodiment, the height of the ribs 16 (as measured along either the first/second peripheral surfaces 14, 15, from the first surface 65*a* to an opposite end) is configured to provide a desired level of resistance or friction between the bumper member 90 and the frame member 40 when the bumper member 90 is coupled thereto.

Referring now to FIGS. 8 and 10, according to an exemplary embodiment, the bumper member 90 may include a top flange 19 provided between two ribs 16 and projecting upwardly from the ribs 16. According to an exemplary embodiment, the flange 19 is configured to engage the upper segment 42 of the frame member 40, when the bumper member 90 is coupled thereto. Further, the flange 19 may assist a user in properly orienting the bumper member 90 relative to the frame member 40 during installation.

It should be noted that the previously described press-fit configurations between the bumper member 60 and frame member 40 may be used independently or in combination with each other. For example, the upper portion 60*a*, intermediate portion 60*b*, and/or lower portion 60*c* may each be configured to have a press-fit relationship with corresponding portions of the upper frame member 40, and the forward track 43*a* and/or rearward track 44*a* may each be configured to have a press-fit relationship with corresponding portions of the bumper member 60 (e.g., in slots 63, 64), either singularly or in combination with each other.

Also, it should be noted that the geometries and dimensions of the bumper member designs disclosed herein are not limited to what is shown in the FIGURES. For example, a bumper member could include a perimeter that is generally circular (e.g., cylindrical), and one or more flanges, projections, or protrusions may extend outwardly from such a bumper member in order to couple to (e.g., engage, interact, etc.) features of a frame member of a shower enclosure.

Further, it should be noted that although the bumper members disclosed herein may couple to the frame of a shower enclosure (e.g., the frame member 40), it should be understood that the bumper member designs disclosed herein may be coupled to features of a side frame (e.g., the upright frame members 50, or a wall jam). For example, the frame members 50 may include one or more flanges (e.g., members, projections, protrusions, etc.) which extend outwardly from the structural surface 50*a*, and are configured to engage the slots 17, 18, 63, 64.

Also, although the bumper members disclosed herein are generally positioned proximate an upper corner of the shower enclosure frame (e.g., proximately where the upper frame 40 is coupled with the upright frame members 50), it should be understood that one or more bumper members may be coupled to the shower frame at any height in order to engage the shower doors 20*a*, 20*b* at a particular location/height. For example, according to an exemplary embodiment, a bumper member may be coupled to a lower, elongate frame member. According to another exemplary embodiment, a bumper member may be coupled to a middle portion of an upright frame member 50, between the top frame member 40 and a lower frame member. According to another exemplary embodiment, a bumper member may be coupled to a lower portion of an upright frame member 50, proximate a lower frame member.

According to an exemplary embodiment, the bumper member 60 is a unitary, injection molded, homogeneous thermoplastic elastomer (TPE) material. According to other exemplary embodiments, the bumper member 60 may comprise separately formed pieces or a combination of materials that are coupled together (e.g., a rigid plastic, metal, or composite structure element that is overmolded with, coextruded with, or otherwise coupled to a more compliant and/or resilient polymeric material, layered members, etc.), may be made according to other manufacturing methods (e.g., stamping, extruding, cutting, etc., alone or in combination with injection molding), may be made from a non-homogenous material (e.g., fiber reinforced material), other materials (e.g., ethylene propylene diene monomer (EPDM), other rubber or polymer materials), and the like.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement as shown for the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention. Those skilled in the art will appreciate that the bumper member designs disclosed herein may provide a minimalist design, such that fasteners are concealed from the view of a bather, and the number of surfaces of the bumper member which are exposed to the view of a bather are kept to a minimum. Advantageously, this design may improve the aesthetics of the enclosure 1. Further, the bumper member designs disclosed herein provide a generally planar surface that a shower door 20*a*, 20*b* may engage. Advantageously, because the first surfaces 65, 65*a* are generally planar, the force of a shower door 20*a*, 20*b* is distributed across a greater area of the bumper members 60, 90. As a result, the durability and longevity of the bumper members 60, 90 and the shower doors 20*a*, 20*b* may be increased.

What is claimed is:

1. A shower door assembly comprising:

a frame having an upper frame member that is elongated with a generally constant cross-section defining a channel therein, the upper frame member further including a first flange and a second flange that are downwardly extending and spaced apart;

a door configured to slide in a direction parallel with the channel; and a bumper member positioned generally within the channel of the upper frame member and configured to limit movement of the door;

wherein the bumper member is coupled directly to the upper frame member; and wherein the bumper member is configured to be compressed between the first flange and the second flange in a direction normal to a sliding direction of the door.

2. The shower door assembly of claim 1, wherein the channel is downwardly open, and an upper end of the door is configured to slide within the channel in order to contact the bumper member.

3. The shower door assembly of claim 2, further comprising a slide assembly that movingly engages the upper frame member and is statically coupled to the door, wherein the slide assembly does not engage the bumper member.

4. The shower door assembly of claim 1, wherein the bumper member is elastomeric.

5. The shower door assembly of claim 1, wherein the upper frame member includes an inward extending flange that extends into the channel from either the first flange or the second flange, and the bumper member includes a slot in which the inward extending flange is received.

6. The shower door assembly of claim 5, wherein the inward extending flange is compressed in the slot by the bumper member in a direction normal the elongated frame.

7. The shower door assembly of claim 1, wherein a first inward extending flange extends into the channel from the first flange, wherein a second inward extending flange extends into the channel from the second flange, and wherein the bumper member includes a first slot in which the first inward extending flange is positioned and includes a second slot in which the second inward extending flange is positioned.

8. The shower door assembly of claim 7, wherein the door is suspended from the first inward extending flange, and a second door is suspended form the second inward extending flange and is configured to slide in a direction parallel with the channel.

9. A shower door assembly comprising:

a frame having an elongated upper frame member extending generally horizontally between a first end and an opposite second end;

a door configured to slide along a path defined by the upper frame member; and a bumper member having a first surface and a second surface facing away from the first surface, the bumper being directly coupled to the upper frame member;

wherein the second surface of the bumper member is positioned adjacent to a generally vertical surface of an upright frame member that is separate from and that is coupled to one of the first and second ends of the upper frame member, and wherein the door is configured to slide into engagement with the first surface of the bumper member to compress the bumper member against the upright frame member; and wherein the bumper member is compressed between the upper frame member in a direction normal to sliding of the door.

10. The shower door assembly of claim 9, wherein the first surface of the bumper member is generally planar, and the direction of travel of the door is generally perpendicular to the first surface.

11. The shower door assembly of claim 10, wherein the second surface of the bumper member is generally planar and parallel with the first surface of the bumper member.

12. The shower door assembly of claim 9, wherein the upper frame member includes a U-shaped channel, and wherein the bumper member is coupled to the upper frame member with a press-fit relationship such that the bumper member is compressed within the channel in a direction normal to sliding of the door.

13. The shower door assembly of claim 12, wherein the bumper member is releasably coupled to the upper frame member without the use of a fastener and without the use of an adhesive.

14. The shower door assembly of claim 9, wherein the bumper member bears against the generally vertical surface of the upright frame member but is not directly connected thereto.

15. The shower door assembly of claim 9, wherein at least one divot is provided within the second surface of the bumper member;

wherein the at least one divot is configured to be coupled to at least one fastener coupled to the upright frame member.

16. The shower door assembly of claim 9, wherein the at least one divot is configured to be press fit into a portion of at least one fastener.

17. A shower door assembly comprising:

a frame comprising a header, the header extending generally horizontally and including a forward track and a rearward track which are spaced apart and extend generally horizontally;

one or more doors that are supported by and slide parallel with the header; and a bumper coupled to the header;

wherein the bumper is configured to be press-fit between the tracks of the header such that the bumper is compressed by the header in a direction that is horizontal and transverse to movement of the door; and wherein when the bumper is press-fit between the forward and rearward tracks of the header, the header does not contact a top surface or a bottom surface of the bumper such that the bumper is not compressed in a vertical direction by the header.

18. The shower door assembly of claim 17, wherein a forward slot and a rearward slot are formed within the bumper, and wherein forward track is received by the forward slot and the rearward track is received by the rearward slot.

19. The shower door assembly of claim 17, wherein the bumper includes a first surface that bears against a generally vertical surface of an upright frame member that is not the header, and wherein the bumper includes a second surface facing away from the first surface that is configured to be impacted by an upper end of the door, such that the bumper is compressed between the vertical surface of the upright frame member and the door when the second surface is impacted by the door.

20. The shower door assembly of claim 19, wherein the bumper is not directly attached to the upright frame member.

* * * * *